US009859621B2

(12) United States Patent
Paleta, Jr. et al.

(10) Patent No.: US 9,859,621 B2
(45) Date of Patent: Jan. 2, 2018

(54) MULTI-BAND SATELLITE ANTENNA ASSEMBLY AND ASSOCIATED METHODS

(71) Applicant: SPEEDCAST INTERNATIONAL LTD, Botany Ot (AU)

(72) Inventors: Roy J. Paleta, Jr., Melbourne, FL (US); Duncan McCoig, Aberdeen (GB); Mitchell L. Ahrendt, Melbourne, FL (US); Griffin Keith Gothard, Satellite Bch, FL (US); Robert Francis Meehan, Melbourne, FL (US); Francisco Torres, West Melbourne, FL (US); Anthony James Vergamini, Indialantic, FL (US); Colin Strachan, Aberdeenshire (GB); Andrew Lucas, Aberdeen (GB)

(73) Assignee: SPEEDCAST INTERNATIONAL LTD, Botany (AU)

( * ) Notice: Subject to any disclaimer, the term of this patent is extended or adjusted under 35 U.S.C. 154(b) by 227 days.

(21) Appl. No.: 14/608,790

(22) Filed: Jan. 29, 2015

(65) Prior Publication Data

US 2016/0226152 A1 Aug. 4, 2016

(51) Int. Cl.

| | |
|---|---|
| ***H01Q 19/19*** | (2006.01) |
| ***H01Q 1/12*** | (2006.01) |
| ***H01Q 15/00*** | (2006.01) |
| ***H01Q 5/47*** | (2015.01) |
| *H01Q 13/02* | (2006.01) |
| *H01Q 1/42* | (2006.01) |
| *H01Q 1/34* | (2006.01) |

(52) U.S. Cl.

CPC ..... *H01Q 19/191* (2013.01); *H01Q 1/125* (2013.01); *H01Q 5/47* (2015.01); *H01Q 15/0013* (2013.01); *H01Q 19/193* (2013.01); *H01Q 1/34* (2013.01); *H01Q 1/42* (2013.01); *H01Q 13/02* (2013.01)

(58) Field of Classification Search

CPC ..... H01Q 19/191; H01Q 5/47; H01Q 1/125; H01Q 15/0013; H01Q 19/193; H01Q 1/34; H01Q 1/42; H01Q 13/02

USPC ..... 343/779

See application file for complete search history.

(56) References Cited

U.S. PATENT DOCUMENTS

| | | | | |
|---|---|---|---|---|
| 5,373,302 A * | 12/1994 | Wu | H01Q 5/45 343/781 CA | |
| 6,320,553 B1 * | 11/2001 | Ergene | H01Q 19/192 343/761 | |
| 6,512,485 B2 | 1/2003 | Luly et al. | | |
| 6,982,679 B2 | 1/2006 | Kralovec et al. | | |

(Continued)

*Primary Examiner* — Dameon E Levi
*Assistant Examiner* — David Lotter
(74) *Attorney, Agent, or Firm* — Allen, Dyer, Doppelt + Gilchrist, P.A.

(57) ABSTRACT

An antenna assembly includes a main reflector, and a subreflector spaced from the main reflector. The subreflector includes a frequency selective surface (FSS) material that is reflective for a first frequency band and transmissive for both a second frequency band and a third frequency band. A first antenna feed is adjacent the main reflector and is directed toward the subreflector. The first antenna feed is for the first frequency band. The second and third antenna feeds are arranged in a coaxial relationship and are directed toward the main reflector with the subreflector therebetween. The second and third antenna feeds are for the second and third frequencies, respectively.

30 Claims, 5 Drawing Sheets

(56) References Cited

U.S. PATENT DOCUMENTS

| | | | | |
|---|---|---|---|---|
| 7,982,687 | B1 * | 7/2011 | Santoru | H01Q 19/132 343/776 |
| 8,334,815 | B2 | 12/2012 | Monte et al. | |
| 8,497,810 | B2 | 7/2013 | Kits Van Heyningen et al. | |
| 8,514,140 | B1 | 8/2013 | Rao et al. | |
| 8,768,242 | B2 | 7/2014 | Frost et al. | |
| 2002/0028654 | A1 | 3/2002 | Gleyzes et al. | |
| 2002/0140617 | A1 * | 10/2002 | Luly | H01Q 19/132 343/781 CA |
| 2004/0066347 | A1 | 4/2004 | Schiff | |
| 2005/0207375 | A1 | 9/2005 | Schiff | |
| 2006/0040612 | A1 | 2/2006 | Min | |
| 2007/0082603 | A1 * | 4/2007 | Norin | H04H 40/90 455/3.02 |
| 2007/0109212 | A1 * | 5/2007 | Wu | H01Q 19/19 343/781 CA |
| 2008/0298298 | A1 | 12/2008 | Eom et al. | |
| 2009/0022088 | A1 | 1/2009 | Wahlberg et al. | |
| 2011/0068988 | A1 * | 3/2011 | Monte | H01Q 3/18 343/761 |
| 2011/0175781 | A1 | 7/2011 | Kim | |
| 2011/0205136 | A1 | 8/2011 | Runyon et al. | |
| 2011/0217976 | A1 | 9/2011 | Kaplan et al. | |
| 2012/0001816 | A1 | 1/2012 | Blaney | |
| 2013/0077562 | A1 | 3/2013 | Boltz et al. | |
| 2013/0295841 | A1 | 11/2013 | Choi et al. | |
| 2014/0139386 | A1 | 5/2014 | Liu et al. | |
| 2014/0250469 | A1 | 9/2014 | Locatori | |

* cited by examiner

MULTI-BAND SATELLITE ANTENNA ASSEMBLY AND ASSOCIATED METHODS

FIELD OF THE INVENTION

The present invention relates to the field of wireless communications, and more particularly, to a satellite antenna assembly that operates over multiple frequency bands, and related methods.

BACKGROUND

When ships travel across large bodies of water, such as the ocean, they rely on satellite communications to maintain contact on shore. Satellites typically operate over multiple frequency bands, such as C-band and Ku-band, for example. The C-band provides a larger coverage area than the Ku-band. Since the Ku-band operates at a higher frequency than the C-band, shorter wavelength signals are used. Consequently, the Ku-band provides spot beam coverage.

Ships generally include a multi-band satellite antenna assembly that operates over the C-band and the Ku-band. When an oil and gas exploration ship, rig, vessel or other device floating on water (herein referred to as a ship) is operating in the Gulf of Mexico, for example, the multi-band satellite antenna assembly is typically configured to operate in the Ku-band. The Ku-band may be preferred since operating costs are generally lower as compared to operating in the C-band. When the oil and gas exploration ship is traveling across the ocean to the North Sea, for example, the availability of the Ku-band is limited. Consequently, the multi-band satellite antenna assembly is configured to operate in the C-band.

In some embodiments, the multi-band satellite antenna assembly may not simultaneously support both C-band and Ku-band and needs to be manually configured for the desired frequency band. This requires the ship to be at port, and the reconfiguration can be a time consuming and costly process. In other embodiments, the multi-band satellite antenna assembly may simultaneously support both C-band and Ku-band so that manual reconfiguration is not required.

Continued growth and demand for bandwidth has led to new commercial satellite constellations at higher frequency. The O3b satellite constellation is a next generation of satellites that operate in the Ka-band. The Ka-band satellites are deployed in a medium earth orbit as compared to a geosynchronous orbit used by C-band/Ku-band satellite constellations. An advantage of a medium earth orbit is that latency times for voice and data communications are significantly reduced.

There are several multi-band satellite antenna assemblies that support Ku-band and Ka-band but not C-band. For example, U.S. Pat. No. 8,497,810 to Kits van Heyningen et al. discloses an antenna assembly implemented as a multi-beam, multi-band antenna having a main reflector with multiple feed horns and a subreflector having a reflective surface defining an image focus for a Ka-band signal and a prime focus for a Ku-band frequency signal. U.S. Pat. No. 8,334,815 to Monte et al. discloses an antenna assembly implemented as a multi-beam, multi-feed antenna having a primary reflector fitted with a dual mode feed tube and a switchable low noise feed block (LNB) that supports both Ka-band and Ku-band reception.

U.S. published patent application no. 2013/0295841 to Choi et al. discloses a satellite communication system between a source and a destination over multiple satellite communications paths. The satellite communication system first identifies the link performance established in multiple spectrums, then it performs a link comparison among the multiple spectrums (e.g., C-, Ku-, or Ka-Band) so as to determine a spectrum link that provides the highest throughput within an acceptable reliability criteria. The satellite communication system switches among the multiple spectrum links to provide the determined spectrum link between the source and the destination.

SUMMARY

An antenna assembly according to the invention comprises a main reflector, a subreflector spaced from the main reflector and comprising a frequency selective surface (FSS) material that is reflective for a first frequency band and transmissive for both a second frequency band and a third frequency band. A first antenna feed may be adjacent to the main reflector and directed toward the subreflector. The first antenna feed may be for the first frequency band. Second and third antenna feeds may be arranged in a coaxial relationship and directed toward the main reflector with the subreflector therebetween. The second and third antenna feeds may be for the second and third frequencies, respectively.

Incorporating three antenna feeds as part of a multi-band satellite antenna assembly advantageously allows re-use of existing volume and mounting infrastructure with respect to multi-band antenna assemblies already operating with two antenna feeds. Three antenna feeds advantageously allow for additional bandwidth to be supported by the satellite antenna assembly. This may be important for ships, as well as for land-based remote satellite terminals, for example, where installation space and accessibility may be limited.

The main reflector may have a medial opening therein, and the first antenna feed may comprise an antenna feed horn extending through the medial opening. The first antenna feed may be configured as a Cassegrain reflector using the FSS material that is reflective for the first frequency band.

The second antenna feed may comprise an elongated center conductor. The third antenna feed may comprise a series of stepped circular conductors surrounding and spaced apart from the elongated center conductor.

The first frequency band may comprise the Ka-band, the second frequency band may comprise the Ku-band, and the third frequency band may comprise the C-band. Each of the first, second and third antenna feeds may be operable for both transmit and receive.

In addition, the first, second and third antenna feeds may be simultaneously operable. Since selection of anyone of the three antenna feeds may be done on the fly, this avoids the need for manually reconfiguring the antenna assembly to a desired frequency band.

The antenna assembly may further comprise a rotatable base mounting the second and third antenna feeds and the subreflector. A plurality of struts may be coupled between the rotatable base and the subreflector. The antenna assembly may further comprise a radome covering the main reflector and subreflector.

The antenna assembly may further comprise a stabilization platform coupled to the main reflector. The main reflector may have a diameter in a range of 2 to 3 meters, for example.

Another aspect is directed to a method for making an antenna assembly as described above. The method may comprise positioning a subreflector spaced from a main reflector, with the subreflector comprising a frequency selective surface (FSS) material that is reflective for a first frequency band and transmissive for both a second frequency band and a third frequency band. A first antenna feed may be positioned adjacent the main reflector so as to be directed toward the subreflector. The first antenna feed may be for the first frequency band. Second and third antenna feeds arranged in a coaxial relationship may be positioned so as to be directed toward the main reflector with the subreflector therebetween. The second and third antenna feeds may be for the second and third frequencies, respectively.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
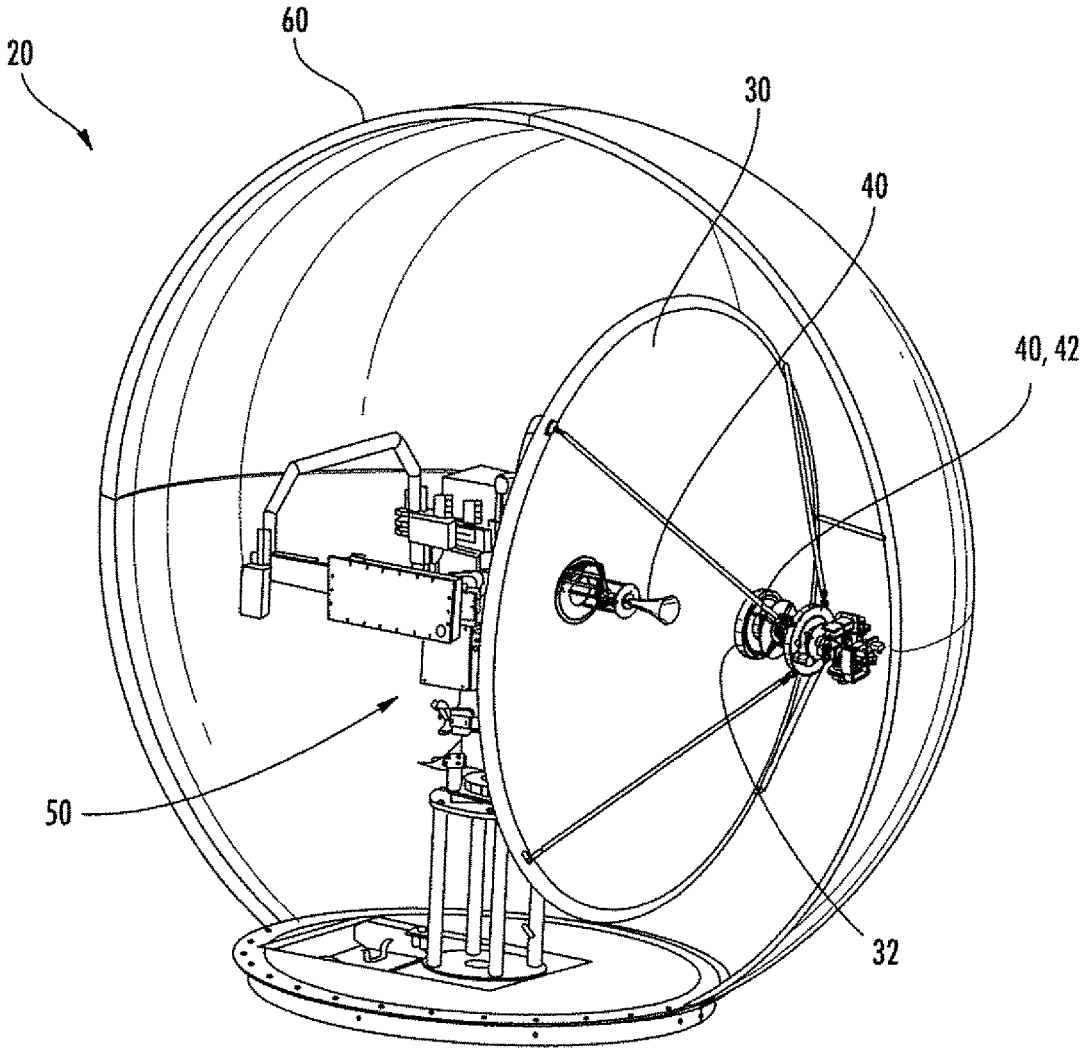
FIG. 1 is a perspective view of a satellite antenna assembly with three antenna feeds in accordance with the present invention.

Referring initially to FIG. 1, a satellite antenna assembly 20 with three antenna feeds will be discussed. The antenna assembly 20 includes a main reflector 30 and a subreflector 32 spaced from the main reflector. The subreflector 32 includes a frequency selective surface (FSS) material that is reflective for a first frequency band and transmissive for both a second frequency band and a third frequency band.

A first antenna feed 40 is adjacent the main reflector 30 and is directed toward the subreflector 32. The first antenna feed 40 is for the first frequency band. Second and third antenna feeds 42, 44 are arranged in a coaxial relationship and are directed toward the main reflector 30 with the subreflector 32 therebetween. The second and third antenna feeds 42, 44 are for the second and third frequencies, respectively.

In the illustrated embodiment, the first frequency band is the Ka-band, the second frequency band is the Ku-band, and the third frequency band is the C-band. The first, second and third antenna feeds 40, 42, 44 may be simultaneously operable. Since selection of anyone of the three antenna feeds 40, 42, 44 may be done on the fly, this avoids the need for manually reconfiguring the antenna assembly to a desired frequency band. The satellite antenna assembly 20 is not limited to these frequency bands. As readily appreciated by those skilled in the art, anyone of the antenna feeds 40, 42, 44 may be configured to operate at a different frequency band. In fact, a fourth frequency band could be added to the satellite antenna assembly 20.

The satellite antenna assembly 20 includes a stabilization platform 50 coupled to the main reflector 30. The stabilization platform 50 moves the main reflector 30 based on a desired azimuth and elevation. The stabilization platform 50 also maintains the main reflector 30 in the desired azimuth and elevation, such as in a shipboard application, as will be appreciated by those skilled in the art. The main reflector 30 is sized based on the operating frequencies of the antenna feeds, and typically has a diameter in a range of 2 to 3 meters, for example. A radome 60 covers the main reflector 30 and the subreflector 32. The radome 60 is configured to be compatible with the first, second and third frequency bands. The illustrated radome 60 is shown partially cut-away to more clearly illustrate positioning of the main reflector 30 and the subreflector 32, as well as the first, second and third antenna feeds 40, 42, 44.

Incorporating three antenna feeds 40, 42, 44 within the satellite antenna assembly 20 advantageously allows re-use of existing volume and mounting infrastructure already allocated for antenna assemblies operating with two antenna feeds. The three antenna feeds 40, 42, 44 also advantageously allow for additional bandwidth to be supported by the satellite antenna assembly 20. This may be important for ships, as well as for land-based remote satellite terminals, for example, where installation space and accessibility may be limited. Each of the first, second and third antenna feeds may be operable for both transmit and receive.

The first, second and third antenna feeds 40, 42, 44 may be simultaneously operable. Since selection of anyone of the three antenna feeds may be done on the fly, this may avoid the need for manually reconfiguring the antenna assembly to a desired frequency band.

The main reflector 30 has a medial opening therein, and the first antenna feed 40 is configured as an antenna feed horn extending through the medial opening. The first antenna feed 40 is arranged in a Cassegrain configuration since it is aimed at the subreflector 32 that is reflective to the first frequency band.

As noted above, the subreflector 32 includes a FSS material that is reflective for the first frequency band (i.e., first antenna feed 40) and is transmissive for both the second frequency band (i.e., second antenna feed 42) and the third frequency band (i.e., third antenna feed 44). For the first frequency band corresponding to the Ka-band, the FSS material is reflective to 17-29 GHz, where the receive frequency is 17-19.5 GHz and the transmit frequency is 27-29 GHz. For the second frequency band corresponding to the Ku-band, the FSS material is transmissive to 10-14.5 GHz, where the receive frequency is 10-12 GHz and the transmit frequency is 13.7-14.5 GHz. For the third frequency band corresponding to the C-band, the FSS material is transmissive to 3.9-6.5 GHz, where the receive frequency is 3.9-4.2 GHz and the transmit frequency is 5.9-6.5 GHz.

Figure 2:
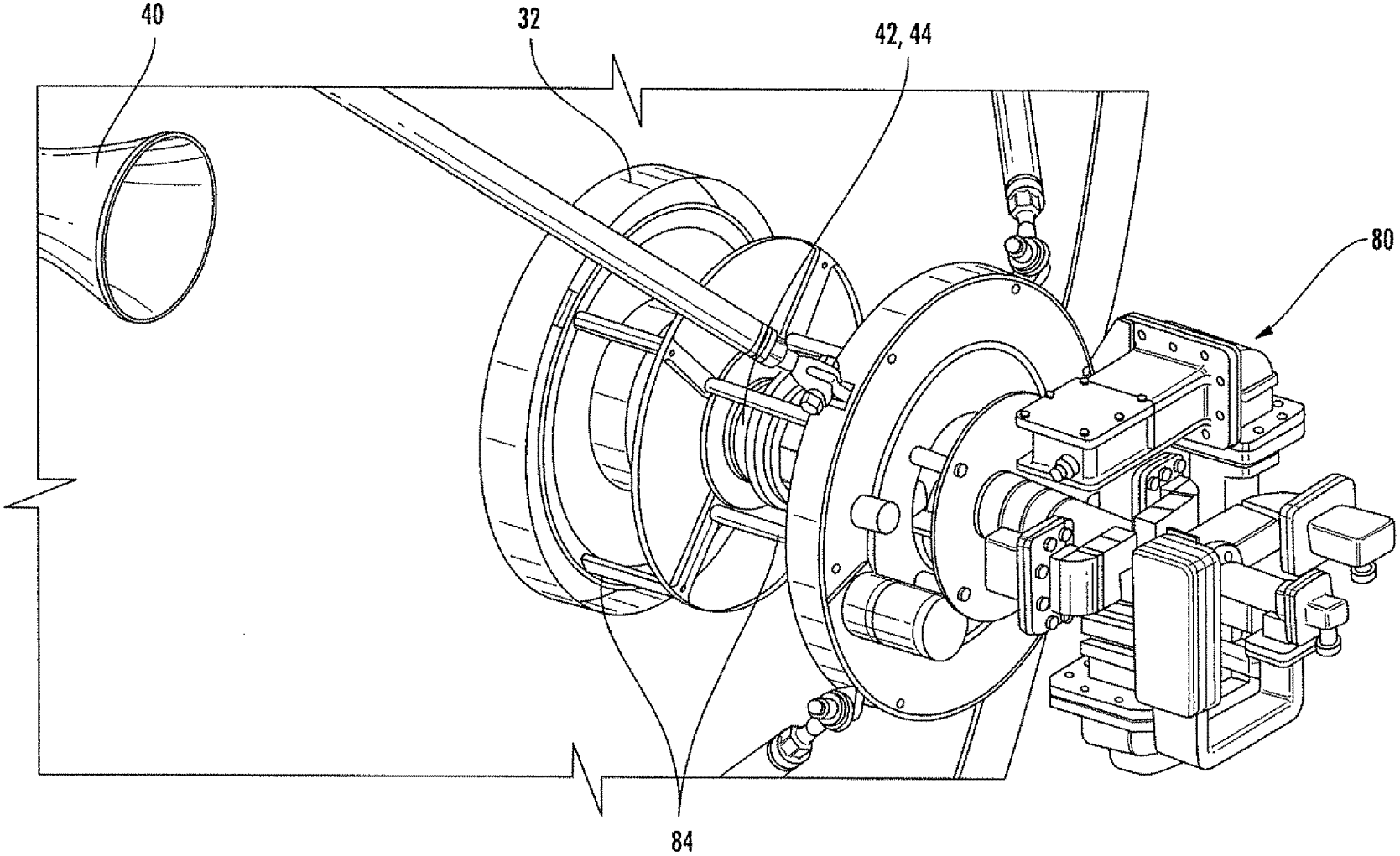
FIG. 2 is a perspective view of the subreflector illustrated in FIG. 1 with respect to the first antenna feed and the second and third antenna feeds.

An enlarged view of the subreflector 32 is provided in FIG. 2. When the first antenna feed 40 is operating in the transmit mode, radio frequency (RF) signals from the first antenna feed are reflected by the subreflector 32 to the main reflector 30 which then directs the RF signal to a satellite. When the first antenna feed 40 is operating in the receive mode, RF signals received by the main reflector 30 are reflected to the subreflector 32, which then directs the RF signal to the first antenna feed 40.

Figure 3:
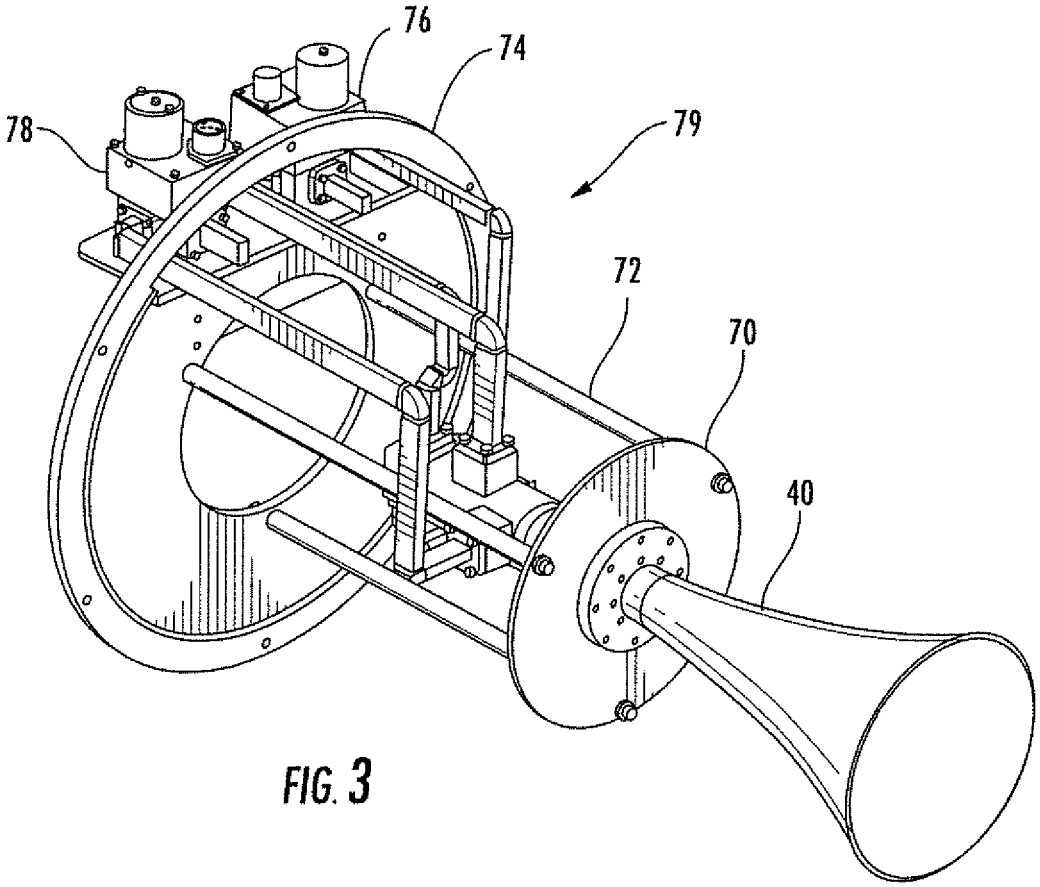
FIG. 3 is a front perspective view of the first antenna feed illustrated in FIG. 1.
Figure 4:
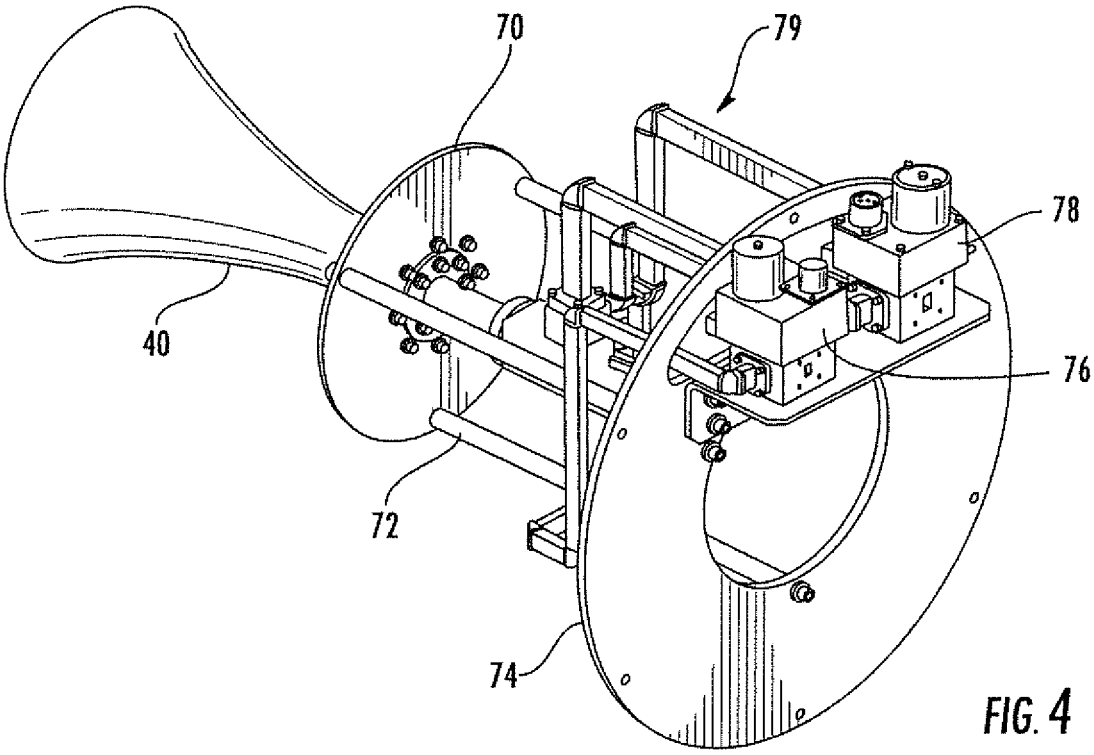
FIG. 4 is a rear perspective view of the first antenna feed illustrated in FIG. 1.

The first antenna feed 40 is mounted to a front antenna feed mounting plate 70, as illustrated in FIGS. 3 and 4. Support rods 72 extend from the front antenna feed mounting plate 70 to a rear antenna feed mounting plate 74. The front antenna feed mounting plate 70 is positioned in front of the main reflector 30, whereas the rear antenna feed mounting plate 74 is positioned to the rear of the main reflector. Transmit and receive switches 76, 78 are carried by the rear antenna feed mounting plate 74. The transmit and receive switches 76, 78 are coupled to a first waveguide assembly 79.

The first waveguide assembly 79 includes a low-noise block downconverter (LNB) for receiving RF signals in the first frequency band. The LNB is a combination of a low-noise amplifier, a frequency mixer, a local oscillator and an IF amplifier. The LNB receives the RF signals from the satellite as collected by the main reflector 30 and reflected by the sub-reflector 32, amplifies the RF signals, and downconverts a frequency of the RF signals to an intermediate frequency (IF). The first waveguide assembly 79 also includes a block upconverter (BUC) for transmitting RF signals to the satellite. The BUC converts from an IF frequency to the desired operating frequency.

Figure 5:
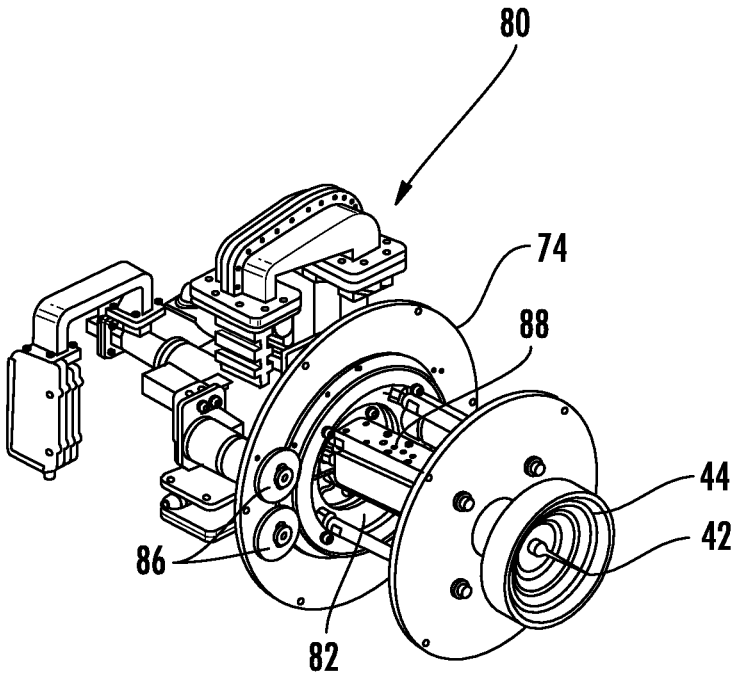
FIG. 5 is a front perspective view of the second and third antenna feeds illustrated in FIG. 1 without the frequency selective surface (FSS) material.
Figure 6:
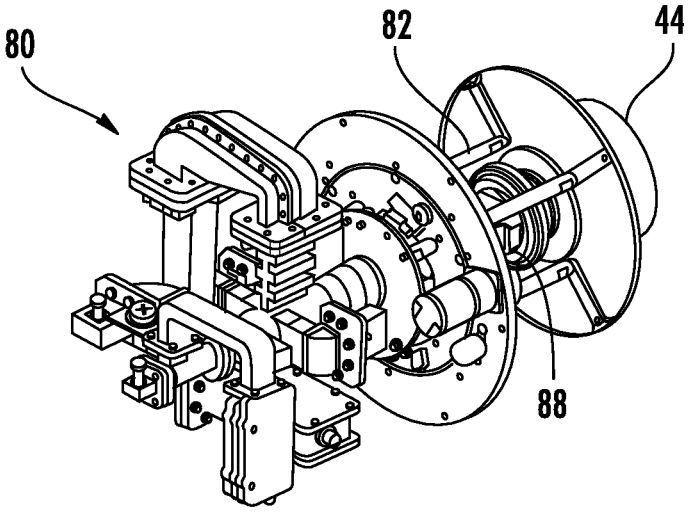
FIG. 6 is a rear perspective view of the second and third antenna feeds illustrated in FIG. 1 without the FSS material.

The second antenna feed 42 is configured as an elongated center conductor, and the third antenna feed 44 is configured as a series of stepped circular conductors surrounding and spaced apart from the elongated center conductor, as best illustrated in FIGS. 5 and 6. The second and third antenna feeds 42, 44 are coupled to a combined waveguide assembly 80. Similar to the first waveguide assembly 79, the combined waveguide assembly 80 includes respective LNBs and BUCs for the second and third antenna feeds 42, 44.

The second and third antenna feeds 42, 44 advantageously share the same physical space. The second and third antenna feeds 42, 44 are configured similar to a coaxial cable. The RF signals for the second antenna feed 42 travel down the inner conductor, whereas the RF signals for the third antenna feed 44 travel down the outer conductor.

The combined waveguide assembly 80 includes a rotatable base 82 mounting the second and third antenna feeds 42, 44 and the subreflector 32. A plurality of struts 84 are coupled between the rotatable base 80 and the subreflector 32. Gears 86 are used to rotate the second and third antenna feeds 42, 44 so that linear polarization is lined up properly with the satellite. The subreflector 32 also rotates with rotation of the second and third antenna feeds 42, 44. Alternatively, the subreflector 32 may be configured so that is does not rotate with rotation of the second and third antenna feeds 42, 44.

The second antenna feed 42 (i.e., Ku-band) only operates in linear polarization (vertical or horizontal). The third antenna feed 44 (i.e., C-band) operates in linear polarization (vertical or horizontal) or circular polarization (left hand or right hand circular polarization). When both the second and third antenna feeds 42, 44 are operating in linear polarization, then both feeds are rotated simultaneously until the proper linear polarization is lined up with the satellite.

If the third antenna feed 44 is operating in circular polarization, then rotation of the rotatable base 82 has no effect on the circular polarization. In other words, circular polarization is not effected by linear polarization. To adjust for left hand or right hand circular polarization, a polarizer 88 is rotated.

Figure 7:
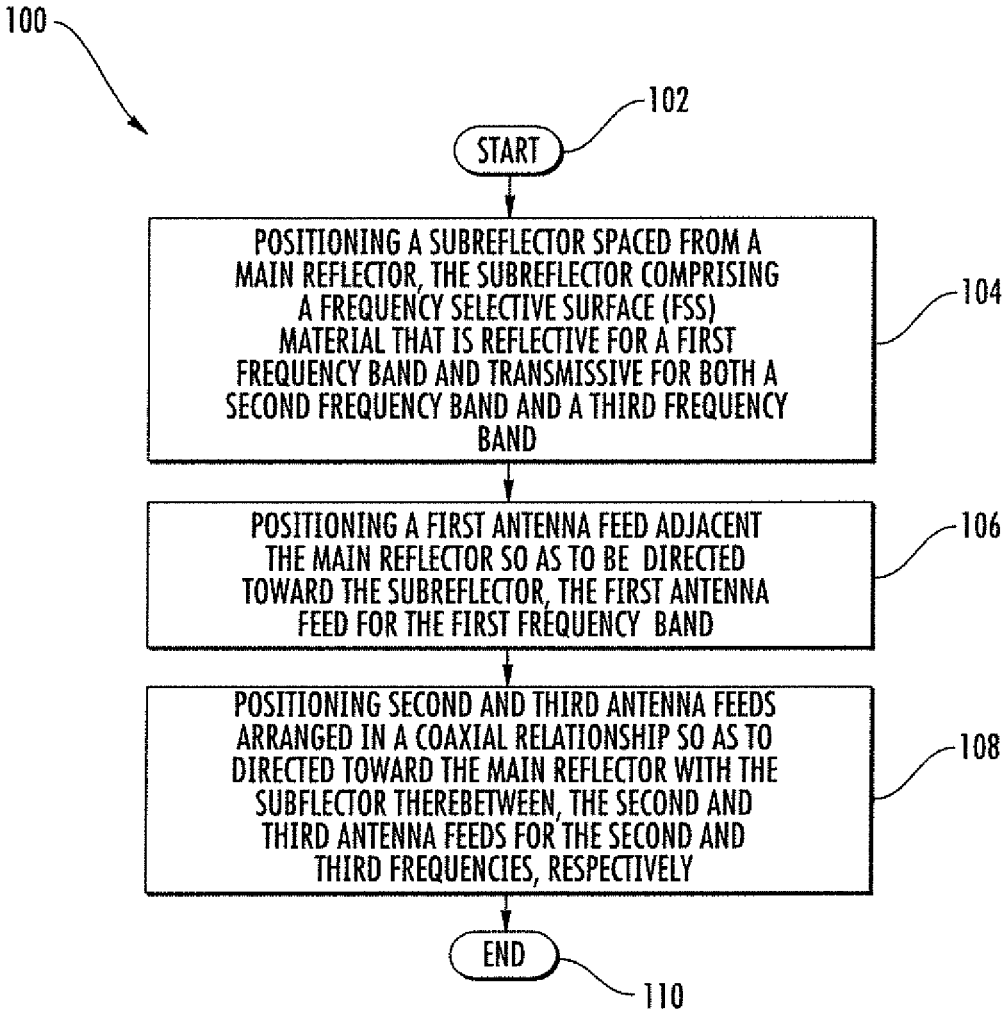
FIG. 7 is a flowchart of a method for making the antenna assembly illustrated in FIG. 1.

Referring now to the flowchart 100 illustrated in FIG. 7, a method for making an antenna assembly 20 as described above will be discussed. From the start (Block 102), the method comprises positioning a subreflector 32 spaced from a main reflector 30 at Block 104, with the subreflector comprising a frequency selective surface (FSS) material that is reflective for a first frequency band and transmissive for both a second frequency band and a third frequency band. A first antenna feed 40 is positioned adjacent the main reflector 30 at Block 106 so as to be directed toward the subreflector 32. The first antenna feed 40 is for the first frequency band. Second and third antenna feeds 42, 44 are arranged in a coaxial relationship and are positioned at Block 108 so as to be directed toward the main reflector 30 with the subreflector 32 therebetween. The second and third antenna feeds 42, 44 are for the second and third frequencies, respectively. The method ends at Block 110.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An antenna assembly comprising:

a main reflector;

a subreflector spaced from said main reflector and comprising a frequency selective surface (FSS) material that is reflective for a first frequency band and transmissive for both a second frequency band and a third frequency band;

a first antenna feed adjacent said main reflector and directed toward said subreflector, said first antenna feed for the first frequency band; and second and third antenna feeds arranged in a coaxial relationship and directed toward said main reflector with said subreflector therebetween, said second and third antenna feeds for the second and third frequency bands, respectively.

2. The antenna assembly according to claim 1 wherein said main reflector has a medial opening therein; and wherein said first antenna feed comprises an antenna feed horn extending through the medial opening.

3. The antenna assembly according to claim 1 wherein said second antenna feed comprises an elongated center conductor.

4. The antenna assembly according to claim 3 wherein said third antenna feed comprises a series of stepped circular conductors surrounding and spaced apart from said elongated center conductor.

5. The antenna assembly according to claim 1 wherein the first frequency band comprises the Ka frequency band, the second frequency band comprises the Ku band, and the third frequency band comprises the C band.

6. The antenna assembly according to claim 1 wherein each of said first, second and third antenna feeds are operable for both transmit and receive.

7. The antenna assembly according to claim 1 wherein said first, second and third antenna feeds are simultaneously operable.

8. The antenna assembly according to claim 1 further comprising:

a rotatable base mounting said second and third antenna feeds, and said subreflector; and a plurality of struts coupled between said rotatable base and said subreflector.

9. The antenna assembly according to claim 1 further comprising a radome covering said main reflector and subreflector.

10. The antenna assembly according to claim 1 further comprising a stabilization platform coupled to said main reflector.

11. The antenna assembly according to claim 1 wherein said main reflector has a diameter in a range of 2 to 3 meters.

12. An antenna assembly comprising:

a main reflector;

a subreflector spaced from said main reflector and comprising a frequency selective surface (FSS) material that is reflective for a first frequency band and transmissive for both a second frequency band and a third frequency band;

a first antenna feed adjacent said main reflector and directed toward said subreflector, said first antenna feed for the first frequency band; and second and third antenna feeds arranged in a coaxial relationship and directed toward said main reflector with said subreflector therebetween, said second and third antenna feeds for the second and third frequency bands, respectively;

said first, second and third antenna feeds being simultaneously operable;

the first frequency band comprising the Ka frequency band, the second frequency band comprising the Ku band, and the third frequency band comprising the C band.

13. The antenna assembly according to claim 12 wherein said main reflector has a medial opening therein; and wherein said first antenna feed comprises an antenna feed horn extending through the medial opening.

14. The antenna assembly according to claim 12 wherein said second antenna feed comprises an elongated center conductor.

15. The antenna assembly according to claim 14 wherein said third antenna feed comprises a series of stepped circular conductors surrounding and spaced apart from said elongated center conductor.

16. The antenna assembly according to claim 12 wherein each of said first, second and third antenna feeds are operable for both transmit and receive.

17. The antenna assembly according to claim 12 further comprising:

a rotatable base mounting said second and third antenna feeds, and said subreflector; and a plurality of struts coupled between said rotatable base and said subreflector.

18. The antenna assembly according to claim 12 further comprising a radome covering said main reflector and subreflector.

19. The antenna assembly according to claim 12 further comprising a stabilization platform coupled to said main reflector.

20. The antenna assembly according to claim 12 wherein said main reflector has a diameter in a range of 2 to 3 meters.

21. A method for making an antenna assembly comprising:

positioning a subreflector spaced from a main reflector, the subreflector comprising a frequency selective surface (FSS) material that is reflective for a first frequency band and transmissive for both a second frequency band and a third frequency band;

positioning a first antenna feed adjacent the main reflector so as to be directed toward the subreflector, the first antenna feed for the first frequency band; and positioning second and third antenna feeds arranged in a coaxial relationship so as to be directed toward the main reflector with the subreflector therebetween, the second and third antenna feeds for the second and third frequency bands, respectively.

22. The method according to claim 21 wherein the main reflector has a medial opening therein; and wherein the first antenna feed comprises an antenna feed horn extending through the medial opening.

23. The method according to claim 21 wherein the second antenna feed comprises an elongated center conductor.

24. The method according to claim 23 wherein the third antenna feed comprises a series of stepped circular conductors surrounding and spaced apart from the elongated center conductor.

25. The method according to claim 21 wherein the first frequency band comprises the Ka frequency band, the second frequency band comprises the Ku band, and the third frequency band comprises the C band.

26. The method according to claim 21 wherein each of the first, second and third antenna feeds are operable for both transmit and receive.

27. The method according to claim 21 wherein the first, second and third antenna feeds are simultaneously operable.

28. The method according to claim 21 further comprising:

mounting the second and third antenna feeds and the subreflector to a rotatable base; and coupling a plurality of struts between the rotatable base and the subreflector.

29. The method according to claim 21 further positioning a radome to cover the main reflector and subreflector.

30. The method according to claim 21 further comprising coupling a stabilization platform to the main reflector.

* * * * *